US009221644B2

(12) United States Patent
Kobayashi

(10) Patent No.: US 9,221,644 B2
(45) Date of Patent: Dec. 29, 2015

(54) MEDIUM CONVEYING DEVICE AND IMAGE FORMING APPARATUS

(71) Applicant: Oki Data Corporation, Tokyo (JP)

(72) Inventor: Takashi Kobayashi, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/555,145

(22) Filed: Nov. 26, 2014

(65) Prior Publication Data

US 2015/0145203 A1 May 28, 2015

(30) Foreign Application Priority Data

Nov. 28, 2013 (JP) ..... 2013-245935

(51) Int. Cl.

| | |
|---|---|
| ***B65H 31/24*** | (2006.01) |
| ***B65H 29/60*** | (2006.01) |
| ***B65H 29/14*** | (2006.01) |
| ***B65H 29/22*** | (2006.01) |
| ***B65H 43/06*** | (2006.01) |

(52) U.S. Cl.

CPC ..... *B65H 31/24* (2013.01); *B65H 29/14* (2013.01); *B65H 29/22* (2013.01); *B65H 29/60* (2013.01); *B65H 43/06* (2013.01); *B65H 2301/333* (2013.01); *B65H 2301/448* (2013.01); *B65H 2301/44822* (2013.01); *B65H 2404/631* (2013.01); *B65H 2405/324* (2013.01)

(58) Field of Classification Search

CPC ..... B65H 29/58; B65H 29/60; B65H 31/24; B65H 2301/132; B65H 2301/1321; B65H 2301/133; B65H 2301/312; B65H 2301/3124; B65H 2301/333; B65H 2301/448; B65H 2301/4482; B65H 2301/44822; B65H 2405/32; B65H 2405/324; B65H 2513/42

See application file for complete search history.

(56) References Cited

U.S. PATENT DOCUMENTS

| | | | | |
|---|---|---|---|---|
| 4,750,016 | A * | 6/1988 | Kusumoto et al. | 399/405 |
| 5,234,213 | A * | 8/1993 | Chen | 271/303 |
| 5,553,528 | A * | 9/1996 | Zoltner | 83/443 |
| 5,862,435 | A * | 1/1999 | Suzumi et al. | 399/68 |
| 7,418,235 | B2 * | 8/2008 | Nonaka et al. | 399/401 |
| 7,699,312 | B2 * | 4/2010 | Fukuda et al. | 271/303 |
| 7,984,909 | B2 * | 7/2011 | Sunohara | 271/301 |
| 8,684,487 | B2 * | 4/2014 | Imoto | 347/16 |
| 8,695,976 | B2 * | 4/2014 | Takahata et al. | 271/303 |

FOREIGN PATENT DOCUMENTS

| | | | |
|---|---|---|---|
| JP | 10035981 | A * | 2/1998 |
| JP | 2006-213518 | A | 8/2006 |

* cited by examiner

*Primary Examiner* — Ernesto Suarez

(74) *Attorney, Agent, or Firm* — Rabin & Berdo, P.C.

(57) ABSTRACT

A medium conveying device including a first stacker to which a medium is ejected, a first conveying path guiding the medium to the first stacker, a second conveying path branched from the first conveying path at a first branching position, and a second stacker to which the medium guided by the second conveying path is ejected. The second stacker is provided on an apparatus main body so as to be openable and closable. A first switching unit is movable between a first position and a second position. The first switching unit guides the medium to the first conveying path at the first branching position when the first switching unit is in the first position, and guides the medium to the second conveying path at the first branching position when the first switching unit is in the second position. A moving mechanism moves the first switching unit from the first position to the second position in conjunction with an opening operation of the second stacker.

14 Claims, 16 Drawing Sheets

MEDIUM CONVEYING DEVICE AND IMAGE FORMING APPARATUS

BACKGROUND OF THE INVENTION

The present invention relates to a medium conveying device including a switching guide for switching between conveying paths, and an image forming apparatus using the medium conveying device.

Conventionally, a type of image forming apparatus includes a plurality of conveying paths (i.e., conveying routes), and a switching guide that switches between the conveying paths using electricity (see, for example, Japanese Application Publication No. 2006-213518).

In this regard, there is a need for enabling switching between guiding directions of the switching guide in a simplified manner.

SUMMARY OF THE INVENTION

According to an aspect of the present invention, there is provided a medium conveying device including a first stacker to which a medium is ejected, a first conveying path guiding the medium to the first stacker, a second conveying path branched from the first conveying path at a first branching position and guiding the medium, and a second stacker to which the medium guided by the second conveying path is ejected. The second stacker is provided on an apparatus main body so as to be openable and closable. The medium conveying device further includes a first switching unit movable between a first position and a second position. The first switching unit guides the medium to the first conveying path at the first branching position when the first switching unit is in the first position, and guides the medium to the second conveying path at the first branching position when the first switching unit is in the second position. The medium conveying device further includes a moving mechanism that moves the first switching unit from the first position to the second position in conjunction with an opening operation of the second stacker.

With such a configuration, the first switching unit is moved from the first position to the second position in conjunction with the operation of the second stacker, and therefore guiding directions of the first switching unit can be switched in a simple manner.

BRIEF DESCRIPTION OF THE DRAWINGS

In the attached drawings:

FIG. 5B is a view for illustrating the configuration and operation of the switching mechanism according to Embodiment 1, and schematically showing a state where the switching guide is switched to an inverting position Pa2 for;

DETAILED DESCRIPTION OF THE PREFERRED EMBODIMENT

Embodiments of the present invention will be described with reference to the attached drawings.

Embodiment 1

Figure 1:
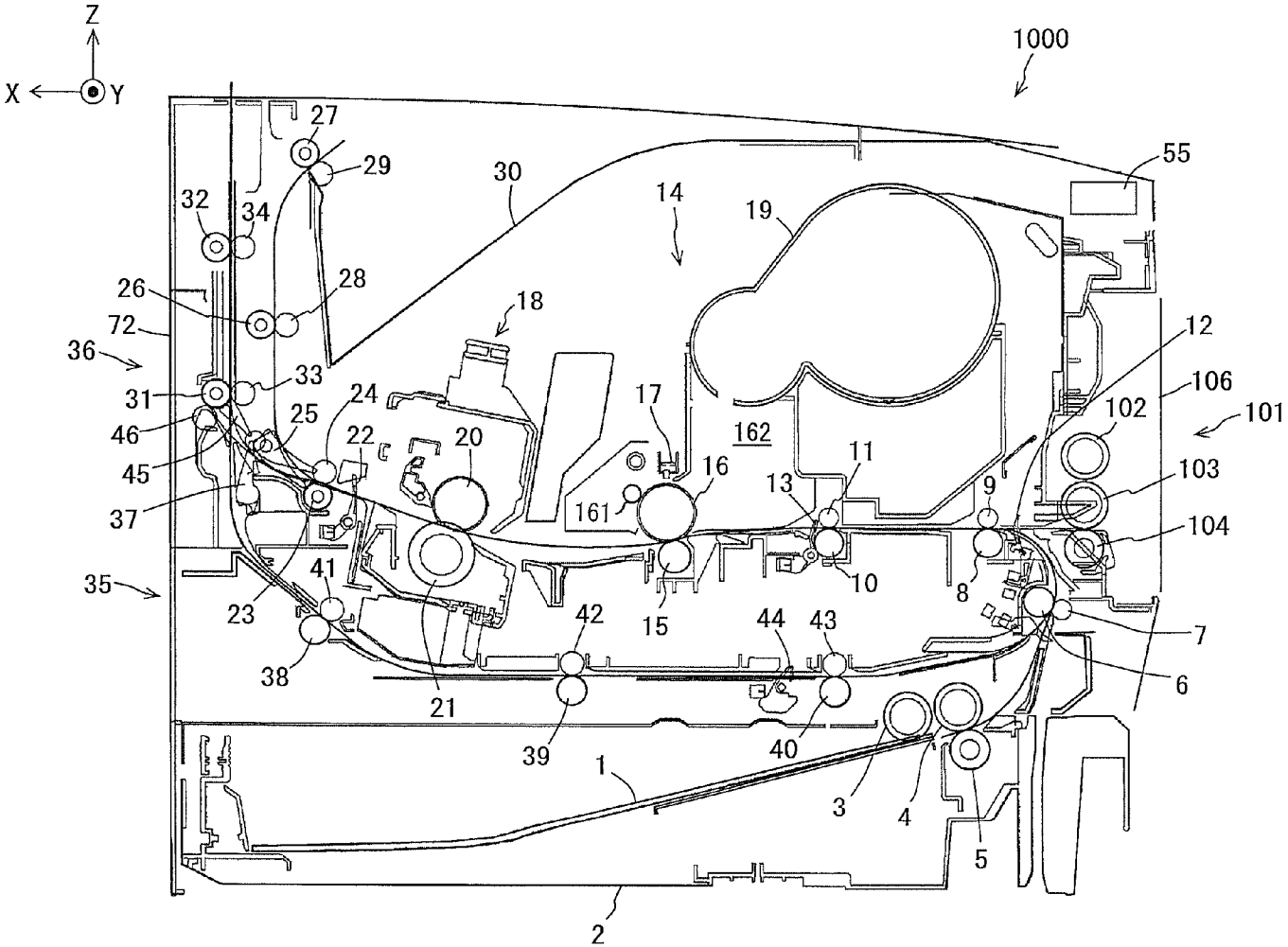
FIG. 1 is a schematic side view showing a printer as an image forming apparatus including a medium conveying device according to Embodiment 1 of the present invention.
Figure 2:
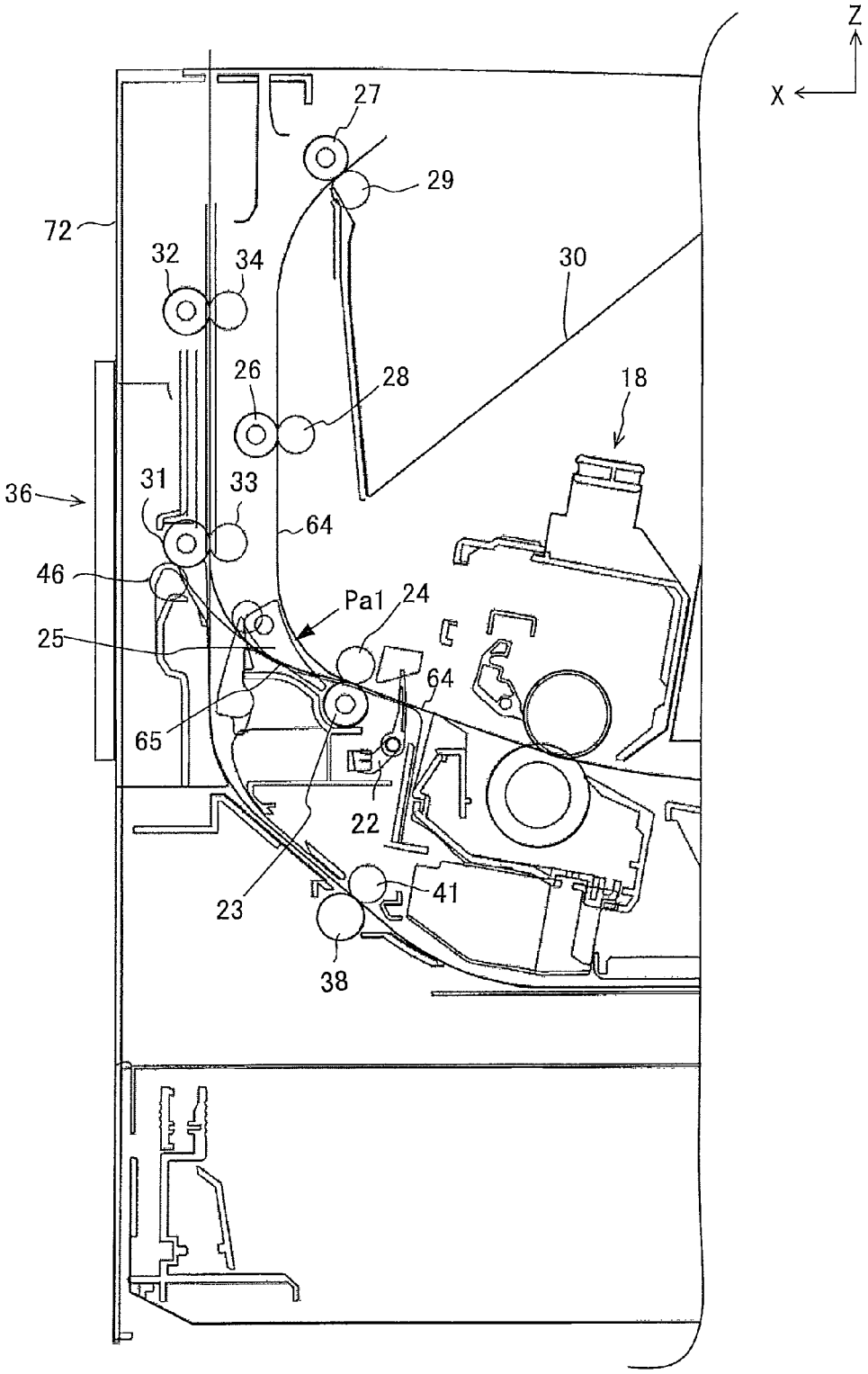
FIG. 2 is a view for illustrating an operation of a switching guide according to Embodiment 1, and showing a portion including the switching guide in an enlarged scale.
Figure 3:
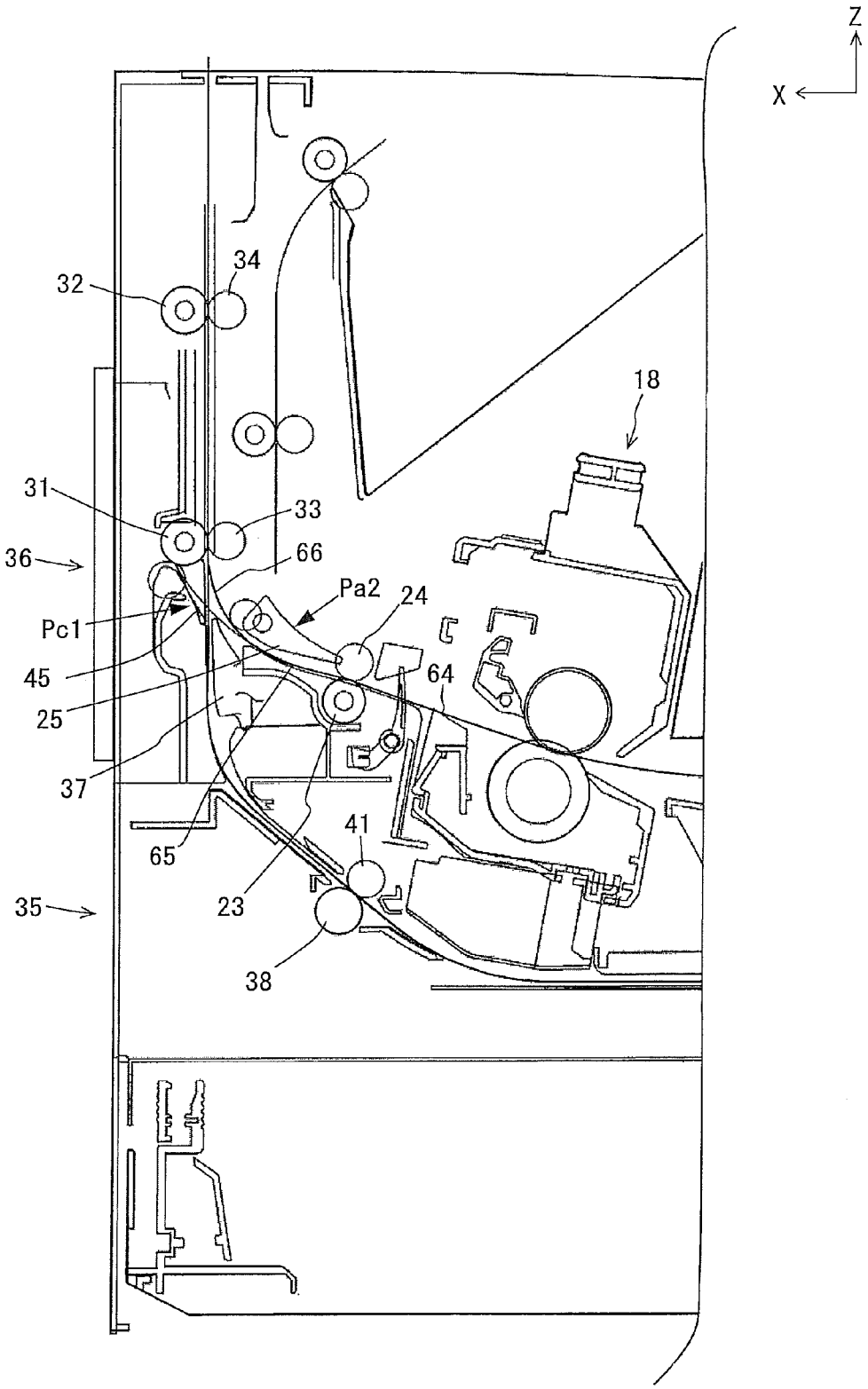
FIG. 3 is a view for illustrating the operation of the switching guide according to Embodiment 1, and showing the portion including the switching guide in an enlarged scale.

FIG. 1 is a schematic side view showing a printer 1000 as an image forming apparatus including a medium conveying device according to Embodiment 1 of the present invention. FIGS. 2 and 3 are views for illustrating a switching operation of a switching guide 25 of the printer 1000, and showing a portion including the switching guide 25 in an enlarged scale.

As shown in FIG. 1, the printer 1000 includes a medium cassette 2 for storing normal recording sheets 1 (i.e., media) such as regular papers, and a multipurpose feeder 101 for storing thick recording sheets such as thick papers. The multipurpose feeder 101 includes a feeding roller 102, a delivery roller 103, a separation roller 104, a tray portion 106 and the like. When the multipurpose feeder 101 is not in use, the multipurpose feeder 101 is retracted in a main body (i.e., an apparatus main body) of the printer 1000 as shown in FIG. 1.

A feeding roller 3, a delivery roller 4 and a separation roller 5 are provided above the medium cassette 2. The feeding roller 3 and the delivery roller 4 are configured to feed the recording sheet 1 from the medium cassette 2. The separation roller 5 is configured to separate recording sheets 1 (fed by the feeding roller 3 and the delivery roller 4) one by one.

A pair of an intermediate conveying roller 6 and a pinch roller 7, a pair of a registration roller 8 and a pressure roller 9, and a pair of an intermediate conveying roller 10 and a pressure roller 11 are provided downstream of the feeding roller 3 and the delivery roller 4 in a conveying direction of the recording sheet 1, and are arranged along a conveying path of the recording sheet 1. The intermediate conveying roller 6 and the pinch roller 7 convey the recording sheet 1 fed from the feeding roller 3 and the delivery roller 4. The registration roller 8 and the pressure roller 9 convey the recording sheet 1 (conveyed from the intermediate conveying roller 6 and the pinch roller 7) while correcting a skew of the recording sheet 1. The intermediate conveying roller 10 and the pressure roller 11 convey the recording sheet 1 conveyed from the registration roller 8 and the pressure roller 9. An entry sensor 12 is provided upstream of the registration roller 8 and the pressure roller 9 in the conveying direction of the recording sheet 1. The entry sensor 12 detects the recording sheet 1. A signal outputted from the entry sensor 12 is used to detect a position of the recording sheet 1 which is being conveyed. A writing sensor 13 is provided downstream of the intermediate conveying roller 10 and the pressure roller 11 in the conveying direction of the recording sheet 1. The writing sensor 13 detects the recording sheet 1. A signal outputted from the writing sensor 13 is used to determine a timing to start image formation in an image forming unit 14 described below. The image forming unit 14 is provided downstream of the writing sensor 13 in the conveying direction of the recording sheet 1.

The image forming unit 14 includes an image drum 16 (i.e., an image bearing body), a charging roller 161 (i.e., a charging member), an LED head (i.e., an exposure unit) 17, a developing unit 162, a transfer roller 15 (i.e., a transfer member), and a toner cartridge 19 (i.e., a developer storage body). The image drum 16 has a circumferential surface (i.e., a photoconductive layer) on which a latent image can be formed by exposure, and rotates in a predetermined direction (clockwise in FIG. 1). The charging roller 161 uniformly charges the surface of the image drum 16. The LED head 17 emits light to expose the surface of the image drum 16 based on image data so as to form a latent image on the surface of the image drum 16. The developing unit 162 develops the latent image with a toner (i.e., a developer) to form a toner image (i.e., a toner image). The transfer roller 15 transfers the toner image to the recording sheet 1. The toner cartridge 19 stores the toner to be supplied to the developing unit 162.

A fixing unit 18 is provided downstream of the image forming unit 14 in the conveying direction of the recording sheet 1. The fixing unit 18 is configured to fix the toner image to the recording sheet 1. For example, the fixing unit 18 includes a heating roller 20 including an internal heat source (not shown) and a pressure roller 21 pressed against the heating roller 20.

An ejection sensor 22, a pair of an ejection roller 23 and a pinch roller 24, and a switching guide 25 are provided downstream of the fixing unit 18 in the conveying direction of the recording sheet 1. The ejection sensor 22 detects the recording sheet 1 which is being ejected. The ejection roller 23 and the pinch roller 24 convey the recording sheet 1 ejected from the fixing unit 18. A plurality of conveying paths, i.e., a first conveying path 64 and a second conveying path 65 are provided downstream of the fixing unit 18 in the conveying direction of the recording sheet 1.

The ejection roller 23 and the pinch roller 24 are provided along the first conveying path 64. The second conveying path 65 is branched from the first conveying path 64 at a first branching position, and extends toward a face-up tray 36.

As shown in FIG. 2, the switching guide 25 (i.e., a first switching unit) is provided for switching between the first conveying path 64 and the second conveying path 65. The switching guide 25 is movable between an ejection position Pa1 (i.e., a first position) and an inverting position Pa2 (i.e., a second position). When the switching guide 25 is in the ejection position Pa1, the switching guide 25 guides the recording sheet 1 (conveyed from the ejection roller 23) along the first conveying path 64. When the switching guide 25 is in the inverting position Pa2 (FIG. 3), the switching guide 25 guides the recording sheet 1 to the second conveying path 65.

Along the first conveying path 64, a pair of an ejection roller 26 and a pinch roller 28, and a pair of an ejection roller 27 and a pinch roller 29 are provided downstream of the switching guide 25 in the conveying direction of the recording sheet 1 (from the ejection roller 23 and the pinch roller 24). The ejection roller 26 and the pinch roller 28 convey the recording sheet 1 along the first conveying path 64. The ejection roller 27 and the pinch roller 29 eject the recording sheet 1 through an ejection opening. A stacker 30 (i.e., a first stacker) is provided so as to receive the recording sheet 1 ejected by the ejection roller 27 and the pinch roller 29.

As shown in FIG. 3, a third conveying path 66 is branched from the second conveying path 65 at a second branching position. A face-up tray switching guide 45 (i.e., a second switching unit) is provided for switching between the third conveying path 66 and the second conveying path 65. The face-up tray switching guide 45 is movable between a retracted position Pc1 (i.e., a third position) shown in FIG. 3 and an ejection position Pc2 (i.e., a fourth position) shown in FIG. 18. A pair of a conveying roller 31 and a pinch roller 33, and a pair of a conveying roller 32 and a pinch roller 34 are provided along the third conveying path 66. The pair of the conveying roller 31 and the pinch roller 33, and the pair of the conveying roller 32 and the pinch roller 34 convey the recording sheet 1 along the third conveying path 66.

The recording sheet 1 conveyed to the second conveying path 65 from the first conveying path 64 is guided to the third conveying path 66 (branched from the second conveying path 65) by the face-up tray switching guide 45 in the retracted position Pc1 (i.e., the third position). The recording sheet 1 guided to the third conveying path 66 is once conveyed into a draw-in position 57 (FIG. 6) and then conveyed to a duplex printing unit 35 by the conveying roller 31 and the pinch roller 33 and the conveying roller 32 and the pinch roller 34, described later.

Figure 18:
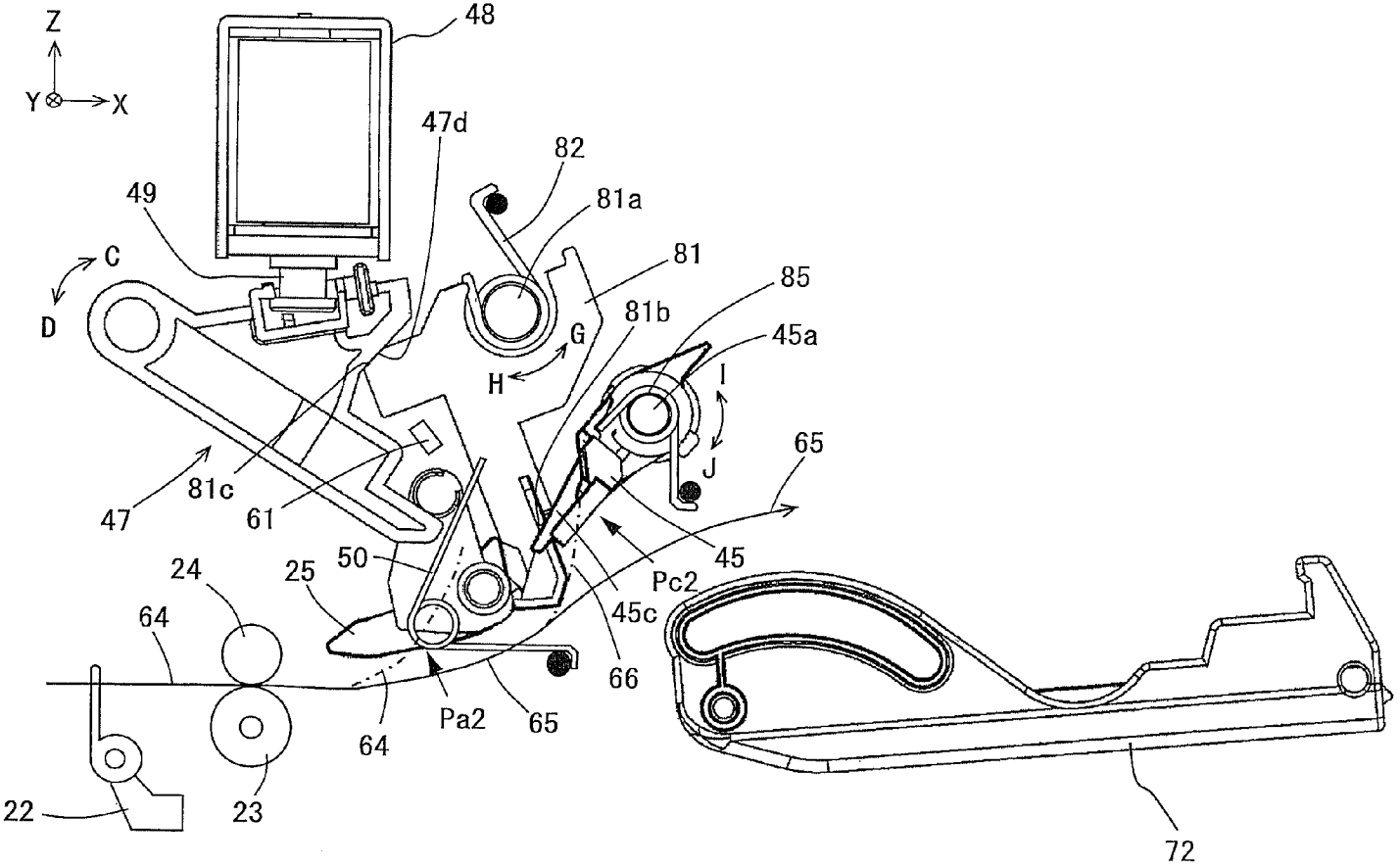
FIG. 18 is a view for illustrating the operation and configuration of the switching mechanism for switching a face-up tray switching guide and the switching guide in conjunction with opening-and-closing of the tray portion according to Embodiment 1.

When a tray portion 72 of the face-up tray 36 is in a closing position, the face-up tray switching guide 45 is in the retracted position Pc1 (FIG. 3). When the tray portion 72 of the face-up tray 36 is in an opening position, the face-up tray switching guide 45 is in the ejection position Pc2 (FIG. 18). When the face-up tray switching guide 45 is in the ejection position Pc2, the face-up tray switching guide 45 guides the recording sheet 1 to the second conveying path 65, so that the recording sheet 1 is ejected to the tray portion 72 of the face-up tray 36 as described later.

The duplex printing unit 35 includes an inverting guide 37, conveying rollers 38, 39 and 40, pinch rollers 41, 42 and 43, and a duplex printing entry sensor 44. The duplex printing unit 35 further includes a conveying path (i.e., a return path)

leading to the intermediate conveying roller 6 and the pinch roller 7. The conveying rollers 38, 39 and 40, the pinch rollers 41, 42 and 43, and the duplex printing entry sensor 44 are provided along the return path. The recording sheet 1 once conveyed into the draw-in position 57 (FIG. 6) is then conveyed to the duplex printing unit 35, and is conveyed along the return path of the duplex printing unit 35 to reach the intermediate conveying roller 6 and the pinch roller 7. The face-up tray 36 includes the face-up tray switching guide 45, a pinch roller 46, the tray portion 72 and the like. When the face-up tray 36 is not in use, the tray portion 72 is retracted, and housed in the main body of the printer 1000 as shown in FIG. 1.

The printer 1000 includes a control unit 55. The control unit 55 controls an entire operation of the printer 1000. Switching control of the switching guide 25 based on signals outputted from the ejection sensor 22 and a tray opening-and-closing detector 61 (FIG. 16) will be described later.

In FIG. 1, an X direction is defined as a conveying direction of the recording sheet 1 when the recording sheet 1 passes through the intermediate conveying roller 10 and the pressure roller 11. Further, a Y direction is defined as a direction of a rotation axis of the intermediate conveying roller 10. Further, a Z direction is defined as a direction perpendicular to both of the X direction and the Y direction. Each of the X direction, the Y direction and the Z direction indicates the same direction when shown in other drawings. Further, the X direction, the Y direction and the Z direction indicate directions with respect to components shown in respective drawings when the components are mounted to the printer 1000 shown in FIG. 1. Here, the Z direction indicates a substantially vertical direction.

A printing operation (i.e., an image forming operation) of the printer 1000 will be described.

In FIG. 1, the recording sheet 1 is fed out of the medium cassette 2 by the feeding roller 3 and the delivery roller 4 to reach the intermediate conveying roller 6 and the pinch roller 7. The recording sheet 1 is further conveyed by a conveying force (i.e., a rotation force) of the intermediate conveying roller 6, and is pressed against a nip portion between the registration roller 8 and the pressure roller 9. The recording sheet 1 is pressed against the nip portion for a predetermined time period, so that a skew of the recording sheet 1 is corrected. The registration roller 8 starts rotation when a predetermined time period has elapsed after the recording sheet 1 is detected by the entry sensor 12, and conveys the recording sheet 1 (the skew of which is corrected) to the intermediate conveying roller 10 and the pressure roller 11. The intermediate conveying roller 10 rotates to convey the recoding sheet 1 toward a nip portion (i.e., a transfer portion) between the image drum 16 and the transfer roller 15. The writing sensor 13 detects the recording sheet 1 passing through the intermediate conveying roller 10 and the pressure roller 11, and outputs a signal. In accordance with the signal outputted from the writing sensor 13, the control unit 55 causes the image forming unit 14 to start image formation.

In the image forming unit 14, the image drum 16 starts rotating, and the surface of the image drum 16 is uniformly charged by the charging roller 161. Further, in accordance with the signal outputted from the writing sensor 13, the LED head 17 starts light emission based on image data so as to form a latent image on the image drum 16. The latent image on the image drum 16 is developed with the toner by the developing unit 162, so that a toner image is formed on the image drum 16.

When the toner image on the image drum 16 reaches the transfer portion between the image drum 16 and the transfer roller 15 (by the rotation of the image drum 16), the toner image is transferred from the image drum 16 to the recording sheet 1 passing through the transfer portion. The recording sheet 1 with the transferred toner image is conveyed to the fixing unit 18. When the recording sheet 1 passes through a nip portion between the heating roller 20 and the pressure roller 21, the toner image is fixed to the recording sheet 1 by application of heat and pressure.

In the case of a simplex printing, the recording sheet 1 (with the fixed toner image) is guided to the first conveying path 64 by the switching guide 25. In this case, the recording sheet 1 is ejected, and is placed on the stacker 30. In the case of a duplex printing, the recording sheet is guided to the second conveying path 65 by the switching guide 25, and is conveyed to the duplex printing unit 35.

Figure 4:
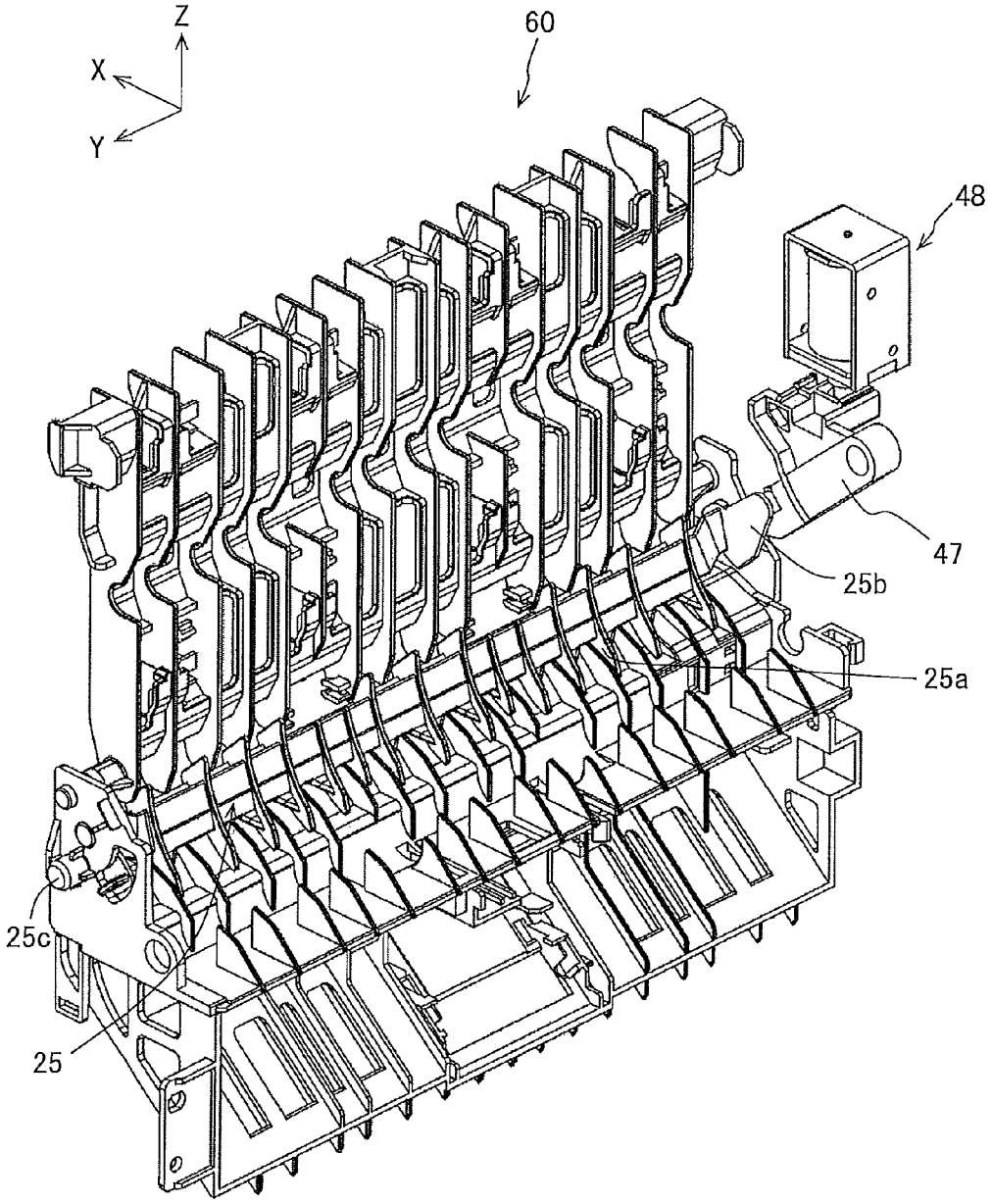
FIG. 4 is a perspective view showing a guide chassis and a switching mechanism for switching the switching guide according to Embodiment 1.
Figure 5B:
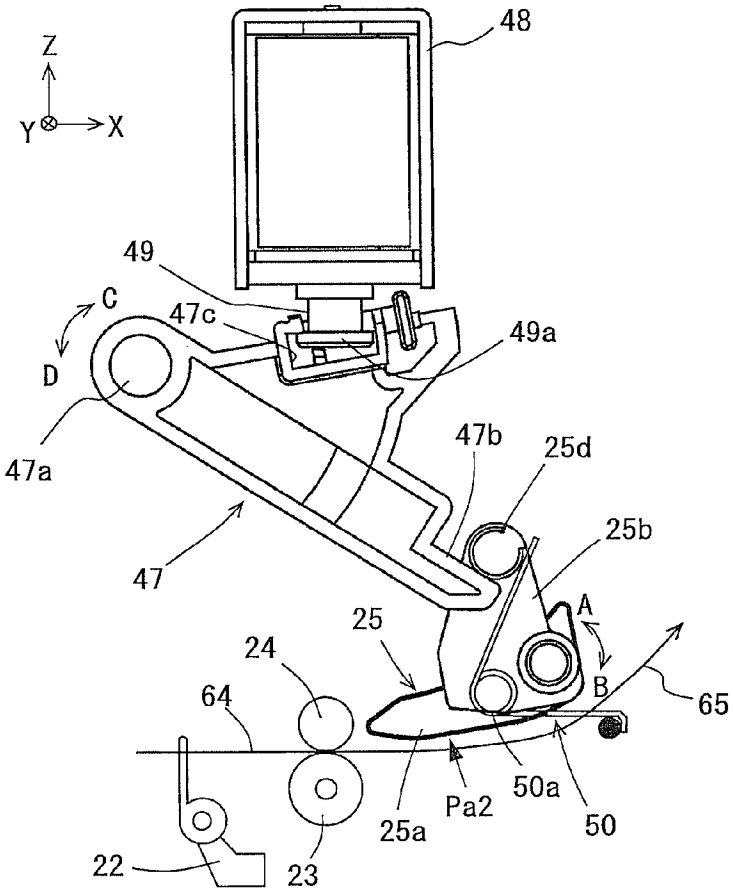
Figure 5A:
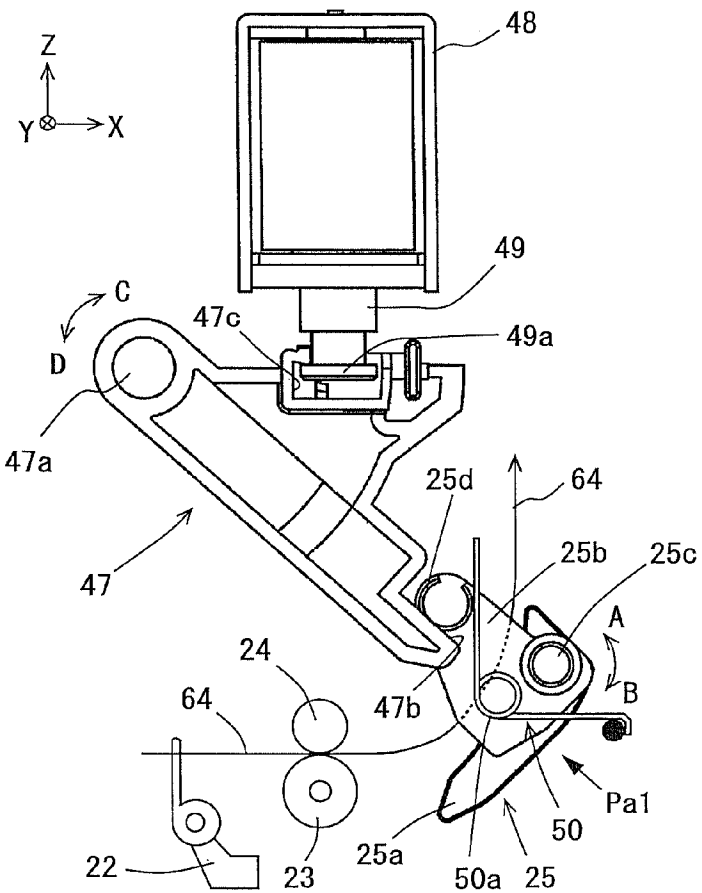
FIG. 5A is a view for illustrating a configuration and operation of the switching mechanism according to Embodiment 1, and schematically showing a state where the switching guide is switched to an ejection position Pa1.

FIG. 4 is a perspective view illustrating a guide chassis 60 and a switching mechanism for switching the switching guide 25. The guide chassis 60 rotatably supports the switching guide 25, and forms a part of a conveying path in the vicinity of the switching guide 25. FIGS. 5A and 5B are schematic views for illustrating a configuration and operation of the switching mechanism for switching the switching guide 25 between the ejection position Pa1 (FIG. 2) and the inverting position Pa2 (FIG. 3). In particular, FIG. 5A shows a state where the switching guide 25 is switched to the ejection position Pa1 (i.e., the first position), FIG. 5B shows a state where the switching guide 25 is switched to the inverting position Pa2 (i.e., the second position).

As shown in FIG. 4, the switching guide 25 is rotatably supported by the guide chassis 60. An electromagnetic solenoid 48 and a first link lever 47 (i.e., a driving unit) constituting the switching mechanism for the switching guide 25 are provided on a right side (i.e., −Y side) of the guide chassis 60. FIGS. 5A and 5B show the guide chassis 60 as seen from −Y side (i.e., the switching mechanism side).

As shown in FIGS. 4, 5A and 5B, the switching guide 25 includes a rotation shaft 25*c*, a guide portion 25*a* and a side plate portion 25*b*. The rotation shaft 25*c* extends in a direction parallel to the Y direction, and is rotatably supported by the guide chassis 60. The guide portion 25*a* is formed along the rotation shaft 25*c* and is configured to guide the recording sheet 1. The side plate portion 25*b* is formed on an end of the guide portion 25*a* in the −Y direction (i.e., on the right in FIG. 4). An engaging post 25*d* (FIGS. 5A and 5B) is formed on the side plate portion 25*b*, and is located at a position apart from the rotation shaft 25*c*.

In FIGS. 5A and 5B, the first link lever 47 has a rotation shaft 47*a* rotatably supported by the main body of the printer 1000 in such a manner that the rotation shaft 47*a* is parallel to the rotation shaft 25*c* of the switching guide 25. The rotation shaft 47*a* has an engaging portion 47*b* engageable with the engaging post 25*d* of the switching guide 25. The electromagnetic solenoid 48 is mounted to the main body of the printer 1000 in such a manner that a plunger 49 of the solenoid 48 is movable in the vertical direction (i.e., the Z direction). A tip portion 49*a* of the plunger 49 fits into a recess 47*c* formed on the first link lever 47 so that the plunger 49 and the first link lever 47 are linked with each other allowing relative movement.

The torsion spring 50 includes a winding portion 50*a* and both end portions. The winding portion 50*a* of the torsion spring 50 is held by, for example, the guide chassis 60. Both end portions of the torsion spring 50 are respectively pressed against the guide chassis 60 and the engaging post 25*d* of the switching guide 25. The torsion spring 50 biases the switching guide 25 in a direction shown by an arrow A, i.e., in a direction in which the engaging post 25*d* moves toward the engaging portion 47*b* of the first link lever 47 (i.e., a direction in which the switching guide 25 moves from the inverting position Pa2 to the ejection position Pa1).

In the switching mechanism constituted as above, in a state where no current flows through the electromagnetic solenoid 48, i.e., when the electromagnetic solenoid 48 is turned OFF, the plunger 49 is held in a lower end position (i.e., a releasing position) by gravity as shown in FIG. 5A. Therefore, the first link lever 47 linked with the plunger 49 is prevented from further rotating in a direction shown by an arrow C. In this state, the switching guide 25 (pressed against the first link lever 47 by a force of the torsion spring 50) is held in the ejection position Pa1.

In contrast, in a state where a current flows through the electromagnetic solenoid 48, i.e., when the electromagnetic solenoid 48 is turned ON, the plunger 49 is attracted and moves upward as shown in FIG. 5B. Therefore, the first link lever 47 linked with the plunger 49 rotates in a direction shown by an arrow D resisting the force of the torsion spring 50. As the first link lever 47 rotates, the switching guide 25 rotates in a direction shown by an arrow B. While the plunger 49 is held in an upper end position by being attracted, the switching guide 25 (pressed against the first link lever 47) is held in the inverting position Pa2.

In this regard, the control unit 55 controls the current applied to the electromagnetic solenoid 48.

In a practical use, a most frequently used destination for the recording sheet 1 is the stacker 30. In this embodiment, the recording sheet 1 is conveyed to the stacker 30 in a state where the electromagnetic solenoid 48 is OFF. Therefore, it is not necessary to turn ON the electromagnetic solenoid 48 (for conveying the recording sheet 1 to the stacker 30) every time the printer 1000 is turned ON. Accordingly, electric power consumption can be reduced.

FIGS. 6 through 9 are schematic views for illustrating conveyance of the recording sheet 1 in the duplex printing. The conveyance of the recording sheet 1 in the duplex printing will be described with reference to FIGS. 6 through 9. Here, the face-up tray switching guide 45 is in the retracted position Pc1 (FIG. 3).

When printing on a surface (referred to as a first surface) of the recording sheet 1 is completed and a leading edge of the recording sheet 1 conveyed along the first conveying path 64 reaches the ejection sensor 22, the ejection sensor 22 outputs a signal to the control unit 55. Upon receiving the output signal from the ejection sensor 22, the control unit 55 turns ON the electromagnetic solenoid 48. As the electromagnetic solenoid 48 is turned ON, the switching guide 25 rotates to the inverting position Pa2 as shown in FIG. 5B. Further, the control unit 55 causes the conveying rollers 31 and 32 to rotate in a direction (referred to as a forward direction) to convey the recording sheet 1 to the draw-in position 57. The recording sheet 1 is guided to the second conveying path 65 from the first conveying path 64 by the switching guide 25, and is guided to the third conveying path 66 by the face-up tray switching guide 45 (which is in the retracted position Pc1 as described above) as shown in FIG. 3.

Figure 6:
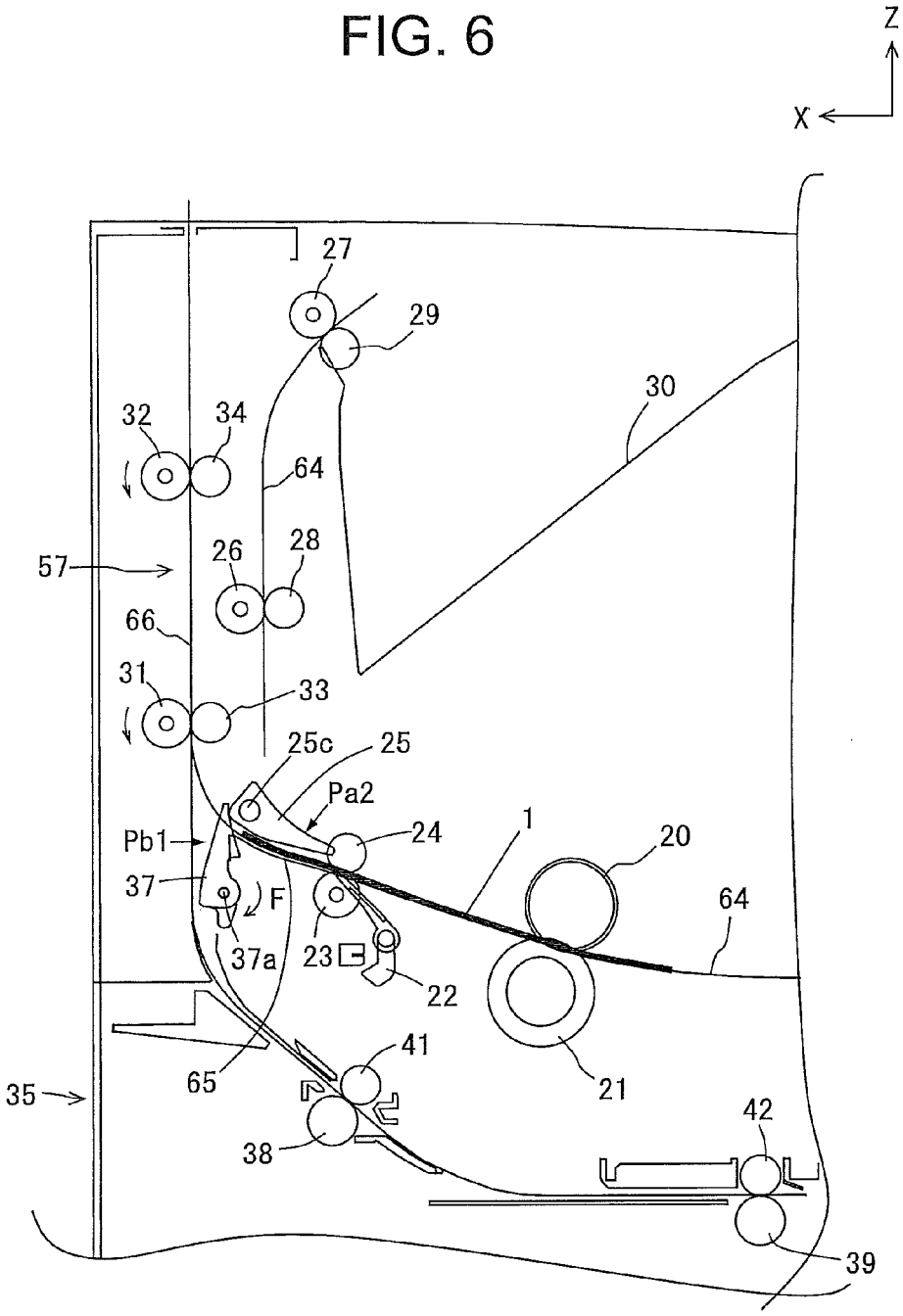
FIG. 6 is a schematic view for illustrating a conveyance of a recording sheet in a duplex printing according to Embodiment 1.

The inverting guide 37 of the duplex printing unit 35 has a rotation shaft 37*a* rotatably supported by the guide chassis 60 (FIG. 4) in such a manner that the rotation shaft 37*a* is parallel to the rotation shaft 25*c* of the switching guide 25. The inverting guide 37 is slightly biased by a biasing member (not shown) in a direction shown by an arrow F (FIGS. 6 and 7), and contacts a regulating portion 51 (FIG. 7) formed on the guide chassis 60. By contact with the regulating portion 51, the inverting guide 37 is held in a reverse conveyance prevention position Pb1 where the inverting guide 37 enters into the second conveying path 65 as shown in FIG. 6. A rotational position of the inverting guide 37 is detected by a not shown detector. Information whether the inverting guide 37 is in the reverse conveyance prevention position Pb1 or not is sent to the control unit 55.

When the leading edge of the recording sheet 1 conveyed along the conveying path 65 (and guided by the switching guide 25 in the inverting position Pa2) contacts the inverting guide 37 (slightly biased and held in the reverse conveyance prevention position Pb1), the recording sheet 1 pushes aside the inverting guide 37, and proceeds into between the conveying roller 31 and the pinch roller 33. The recording sheet 1 is conveyed into the draw-in position 57 by the pair of the conveying roller 31 and the pinch roller 33 and the pair of the conveying roller 32 and the pinch roller 34. When a trailing edge of the recording sheet 1 (conveyed to the draw-in position 57) passes the inverting guide 37, the inverting guide 37 returns from a retracted position Pb2 shown by a dashed line in FIG. 7 to the reverse conveyance prevention position Pb1.

When the control unit 55 recognizes that the inverting guide 37 returns to the reverse conveyance prevention position Pb1, the control unit 55 causes the conveying rollers 31 and 32 to rotate in a direction (i.e., a reverse direction) to convey the recording sheet 1 from the draw-in position 57 to the duplex printing unit 35. Further, the control unit 55 cause the conveying rollers 38, 39 and 40 to rotate in a direction shown by arrows in FIG. 7, i.e., in a direction to convey the recording sheet 1 along the return path toward the intermediate conveying roller 6 and the pinch roller 7.

Therefore, the recording sheet 1 is once conveyed into the draw-in position 57, and is then conveyed to the duplex printing unit 35 while being guided by the inverting guide 37 (having returned to the reverse conveyance prevention position Pb1). In the duplex printing unit 35, the recording sheet 1 is conveyed by the conveying rollers 38, 39 and 40 and the pinch rollers 41, 42 and 43 to reach the intermediate conveying roller 6 and the pinch roller 7 shown in FIG. 1. The recording sheet 1 is further conveyed by the intermediate conveying roller 6 and the pinch roller 7 to the image forming unit 14 in such a manner that a back surface (i.e., a second surface) of the recording sheet 1 faces the image drum 16. As the recording sheet 1 passes the image forming unit 14 and the fixing unit 18, the toner image is transferred and fixed to the back surface of the recording sheet 1. In other words, the toner image is printed on the back surface of the recording sheet 1.

Figure 9:
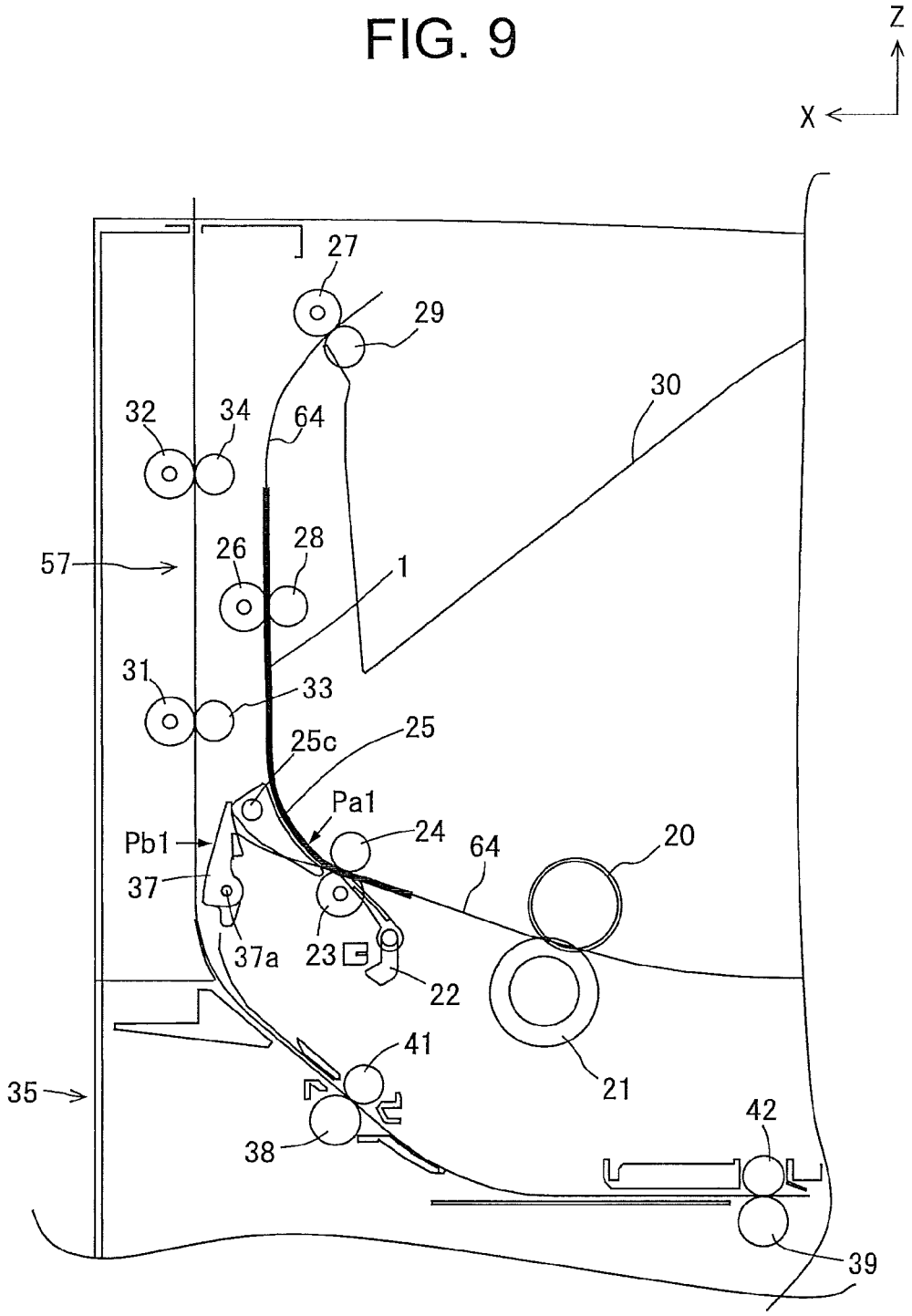
FIG. 9 is a schematic view for illustrating the conveyance of the recording sheet in the duplex printing according to Embodiment 1.

After the toner image is printed on the back surface of the recording sheet 1, when the ejection sensor 22 detects the leading edge of the recording sheet 1 (conveyed along the first conveying path 64), the control unit 55 turns OFF the electromagnetic solenoid 48. Therefore, as described with reference to FIG. 5A, the switching guide 25 rotates to the ejection position Pa1 as shown in FIG. 9, and guides the recording sheet 1 along the first conveying path 64. The recording sheet 1 with toner images printed on both sides is conveyed by the ejection rollers 26 and 27 and the pinch rollers 28 and 29, and is ejected to the stacker 30.

Next, configurations of the multipurpose feeder 101 (used for the thick recording sheets) and the face-up tray 36 will be described.

Figure 10:
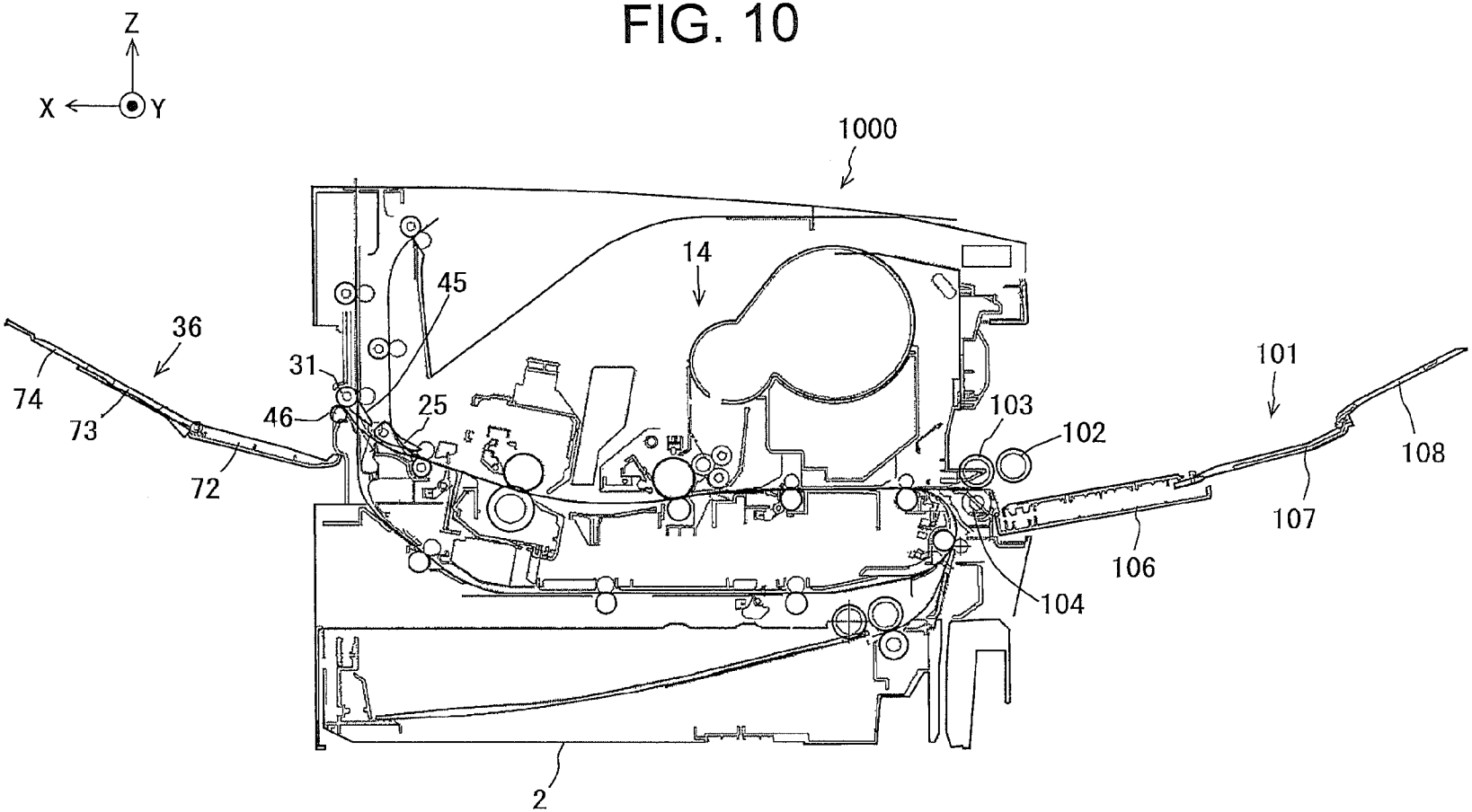
FIG. 10 is a schematic side view showing a printer according to Embodiment 1 in a state where a multipurpose feeder and a face-up tray are both set in use state.
Figure 11:
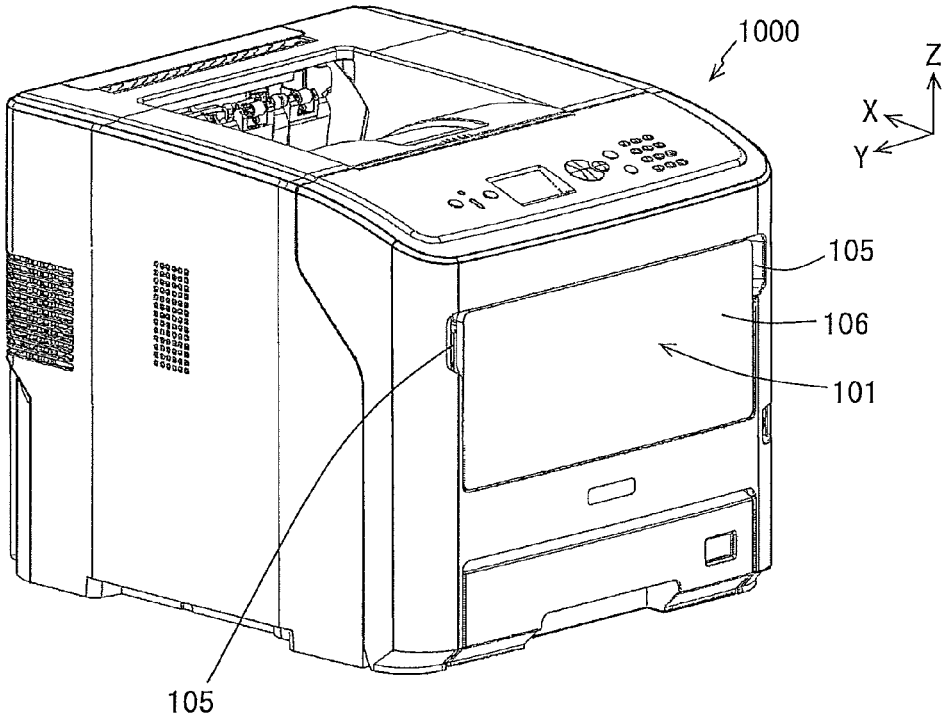
FIG. 11 is a perspective view showing the printer according to Embodiment 1 in a state where the multipurpose feeder is retracted.
Figure 12:
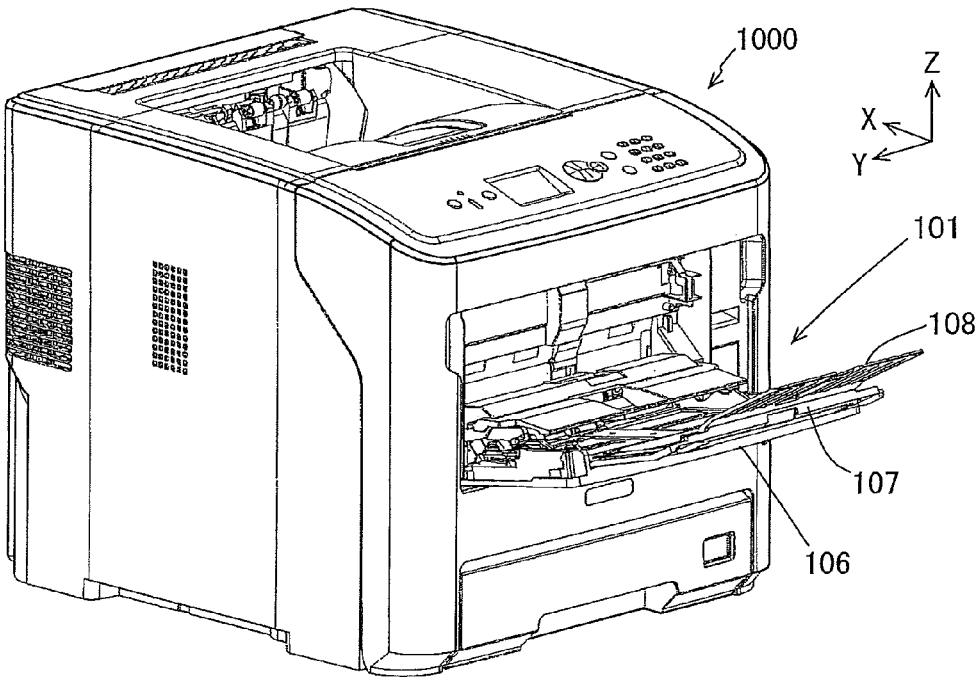
FIG. 12 is a perspective view showing the printer according to Embodiment 1 in a state where the multipurpose feeder is opened (i.e. set to the use state)
Figure 13:
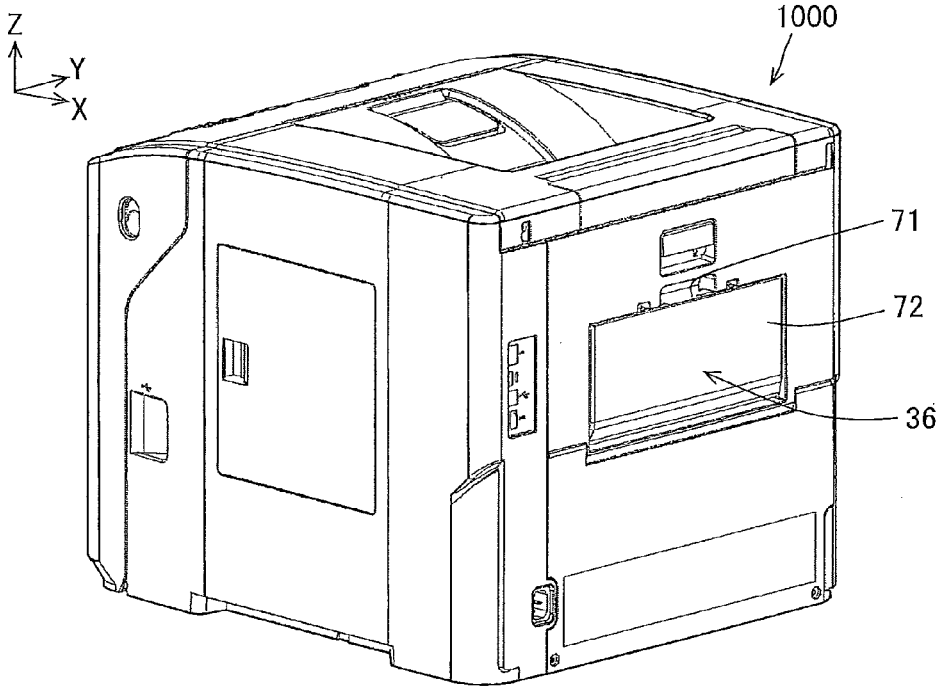
FIG. 13 is a perspective view showing the printer according to Embodiment 1 in a state where the face-up tray is retracted.
Figure 14:
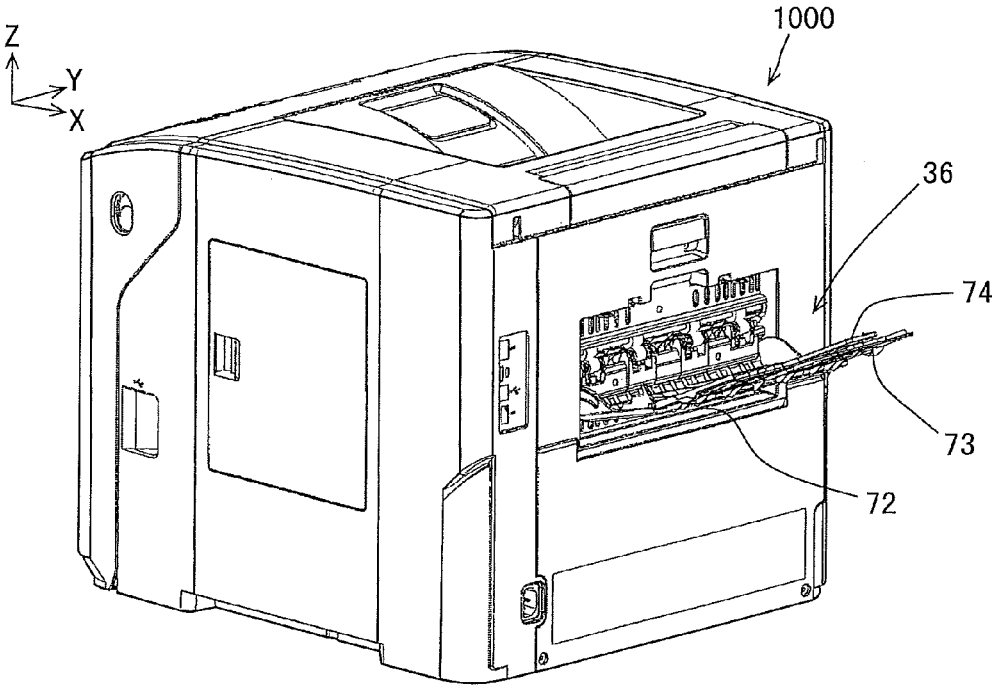
FIG. 14 is a perspective view showing the printer according to Embodiment 1 in a state where the face-up tray is opened (i.e., set to the use state)

FIG. 10 is a schematic side view showing the printer 1000 in a state where the multipurpose feeder 101 and the face-up tray 36 are opened (i.e., set to use state). FIG. 11 is a perspective view showing the printer 1000 in a state where the multipurpose feeder 101 is retracted (i.e., closed). FIG. 12 is a perspective view showing the printer 1000 in a state where the multipurpose feeder 101 is opened (i.e., set to the use state). FIG. 13 is a perspective view showing the printer 1000 in a state where the face-up tray 36 is retracted (i.e., closed). FIG. 14 is a perspective view showing the printer 1000 in a state where the face-up tray 36 is opened (i.e., set to the use state).

In order to set the multipurpose feeder 101 retracted in the main body of the printer 1000 to the use state, a user puts its finger on a handle portion 105, and rotates the tray portion 106 (rotatably supported by the main body of the printer 1000) as shown in FIGS. 11 and 12, so that a locking of the tray portion 106 with respect to the main body of the printer 1000 is released. A rotation of the tray portion 106 is restricted at an angle such that the tray portion 106 is inclined with respect to a horizontal plane. In the restricted position (i.e., an opening position), the tray portion 106 is inclined in such a manner that an end portion of the tray portion 106 is slightly higher than a root end of the tray portion 106. Sub-trays 107 and 108 are housed in the tray portion 106. The sub-trays 107 and 108 are configured to extend frontward from the tray portion 106 in two stages as shown in FIGS. 10 and 12.

When printing is performed on a thick recording sheet (i.e., a medium) stored in the multipurpose feeder 101 set to the use state, the thick recording sheet is placed on the tray portion 106 and the sub-trays 107 and 108 (extending from the tray portion 106) forming a continuous flat surface, and is conveyed toward the image forming unit 14 by the feeding roller 102, the delivery roller 103 and the separation roller 104. In this case, a conveying path of the thick recording sheet is straighter than a conveying path of the normal recording sheet 1 (i.e., a regular paper) from the medium cassette 2 to the image forming unit 14. The straighter conveying path is suitable for the thick recording sheet.

In order to set the face-up tray 36 retracted in the main body of the printer 1000 to the use state, a user puts its finger on a handle portion 71, and rotates the tray portion 72 (rotatably supported by the main body of the printer 1000) as shown in FIGS. 13 and 14, and a locking of the tray portion 72 with respect to the main body of the printer 1000 is released. A rotation of the tray portion 72 is restricted at an angle such that the tray portion 72 is inclined with respect to a horizontal plane. In the restricted position (i.e., an opening position), the tray portion 72 is inclined in such a manner that an end portion of the tray portion 72 is slightly higher than a root end of the tray portion 72. Sub-trays 73 and 74 are housed in the tray portion 72. The sub-trays 73 and 74 are configured to extend frontward from the tray portion 72 in two stages as shown in FIGS. 10 and 14. The tray portion 72 correspond to a second stacker (i.e., a second tray).

Figure 8:
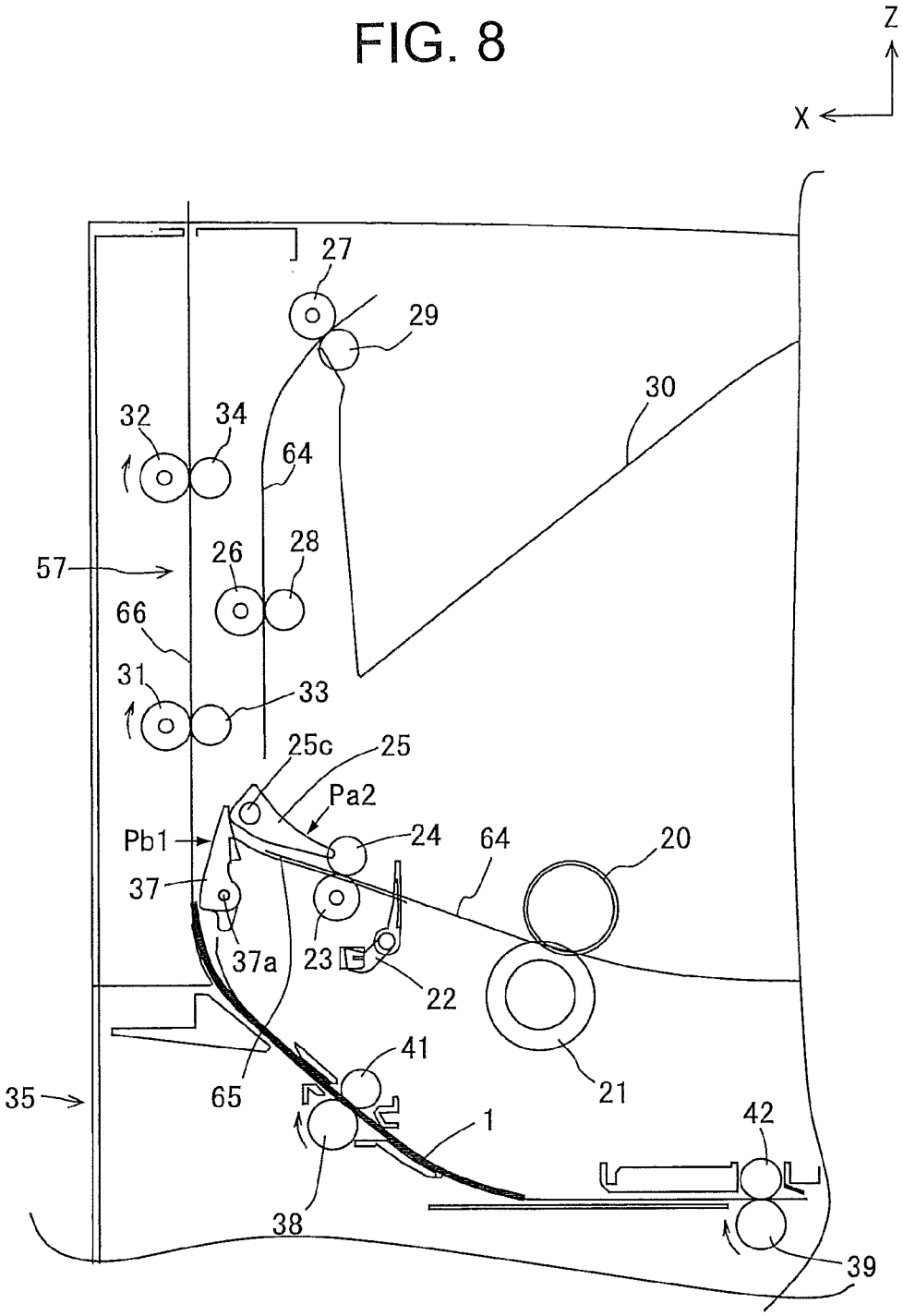
FIG. 8 is a schematic view for illustrating the conveyance of the recording sheet in the duplex printing according to Embodiment 1.
Figure 17:
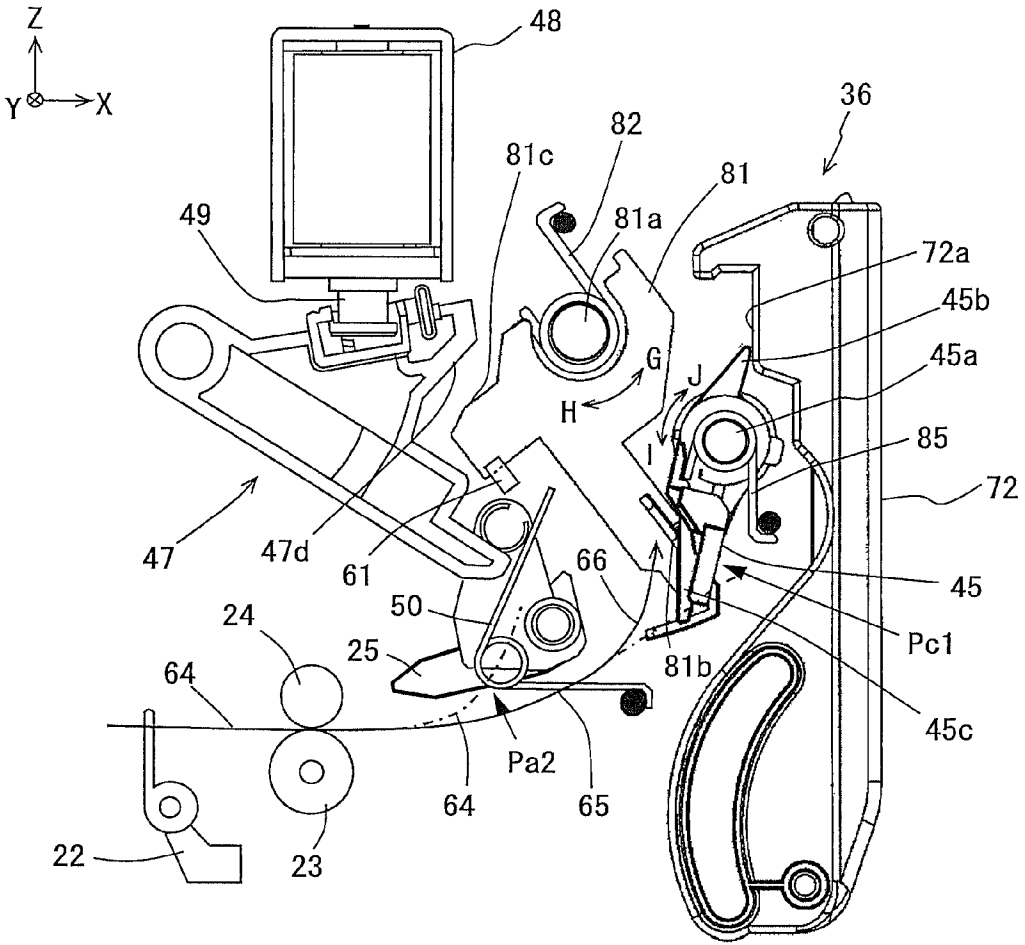
FIG. 17 is a view for illustrating the operation and configuration of the switching mechanism for switching a face-up tray switching guide and the switching guide in conjunction with opening-and-closing of the tray portion according to Embodiment 1.

In order to eject the thick recording sheet to the face-up tray 36 set to the use state (i.e., in the opening position), the switching guide 25 is switched to the inverting position Pa2 shown in FIG. 8, and the face-up tray switching guide 45 is switched to the ejection position Pc2 as shown in FIG. 17 as described later. As shown in FIG. 10, the thick recording sheet (subjected to printing by the image forming unit 14) is guided by the switching guide 25 and the face-up tray switching guide 45, and reaches the conveying roller 31 and the pinch roller 46 (FIG. 4). The conveying roller 31 rotates in the reverse direction, and ejects the thick recording sheet to the tray portion 72 and the sub-trays 73 and 74 that form a continuous flat surface. In this case, a conveying path from the image forming unit 14 to the face-up tray 36 is substantially straight, and is suitable for the thick recording sheet.

Next, a switching mechanism for switching the face-up tray switching guide 45 and the switching guide 25 in conjunction with the opening-and-closing of the tray portion 72 will be described.

Figure 15:
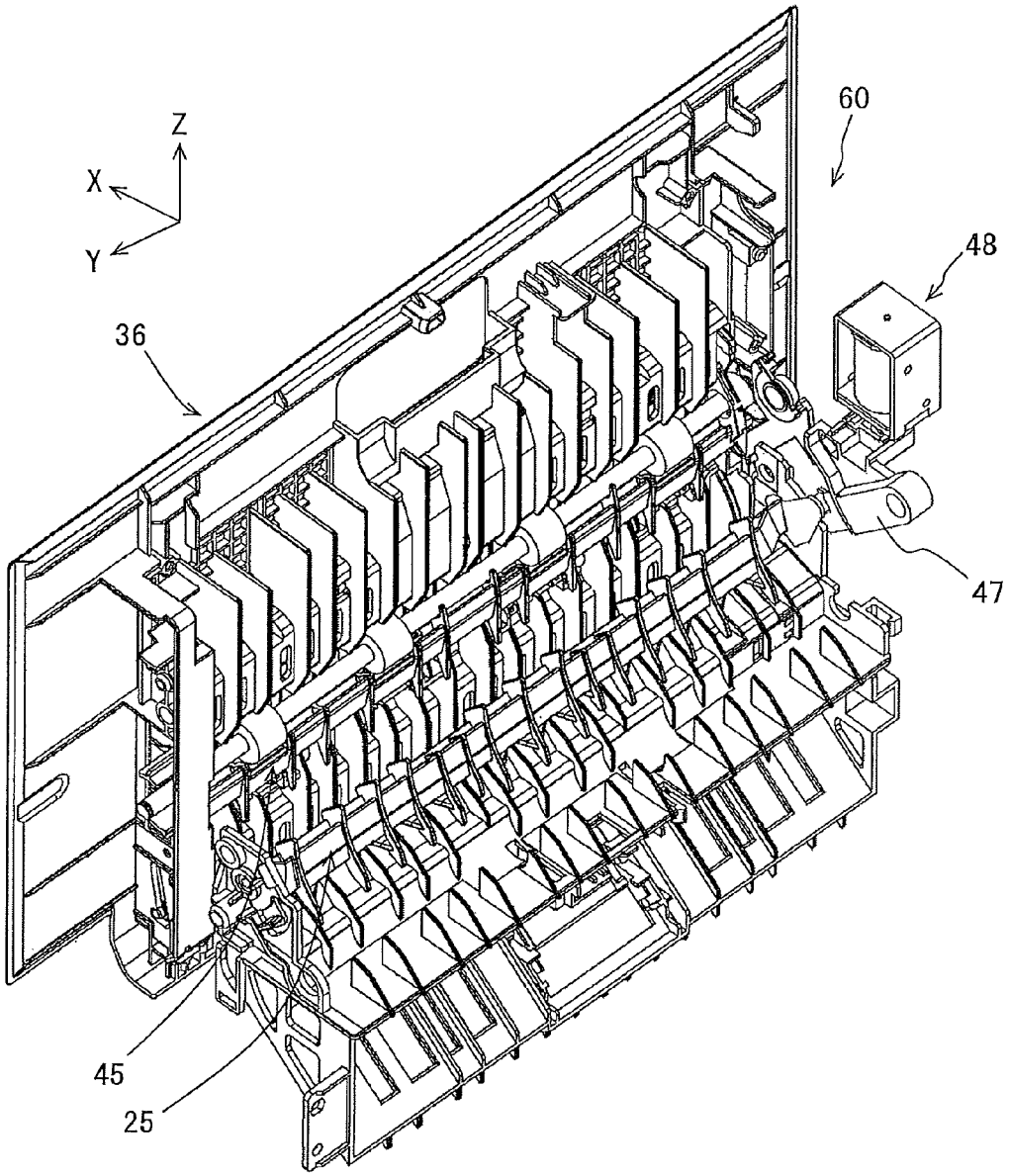
FIG. 15 is a perspective view showing the guide chassis and a switching mechanism for switching a face-up tray switching guide and the switching guide and according to Embodiment 1.
Figure 16:
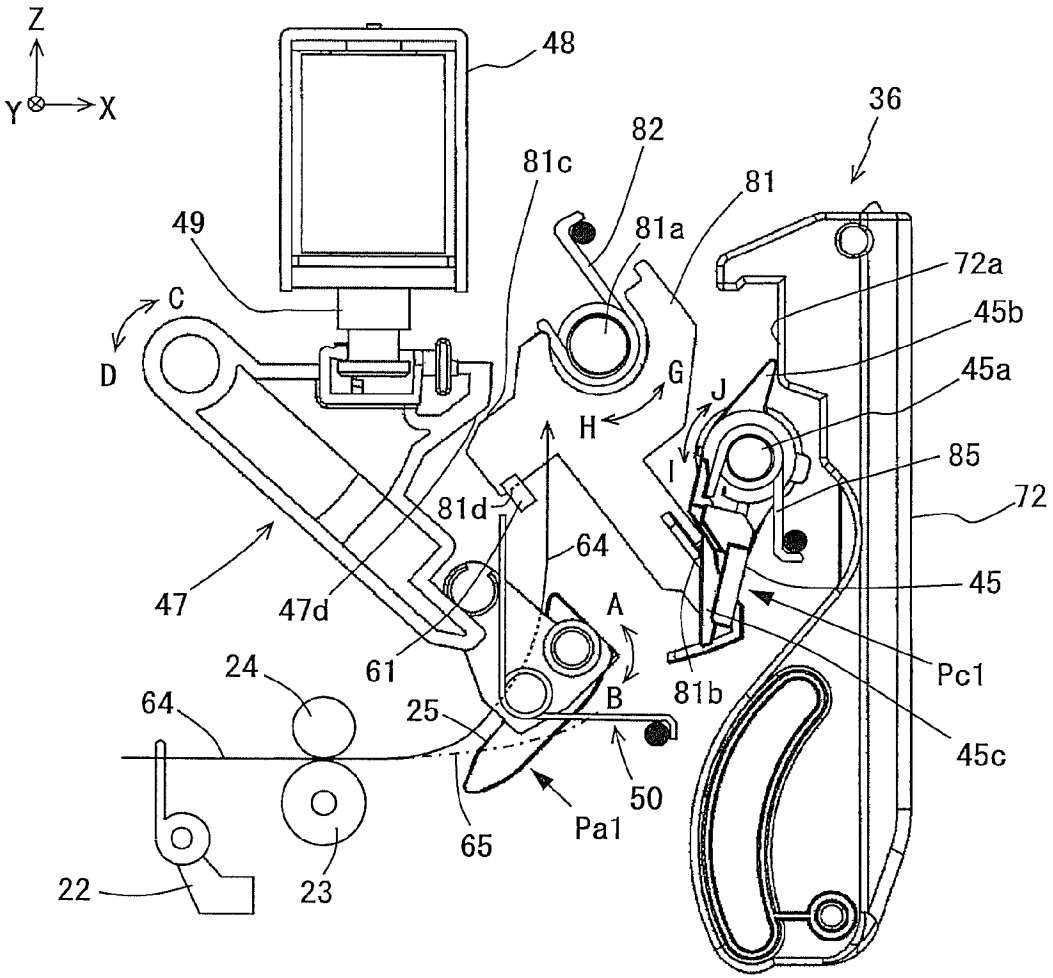
FIG. 16 is a view for illustrating an operation and configuration of the switching mechanism for switching a face-up tray switching guide and the switching guide in conjunction with opening-and-closing of the tray portion according to Embodiment 1.

FIG. 15 is a schematic view showing the guide chassis 60 and the switching mechanism for switching the face-up tray switching guide 45 and the switching guide 25. The guide chassis 60 rotatably supports the switching guide 25 and the face-up tray switching guide 45, and rotatably supports the tray portion 72. The guide chassis 60 constitutes a part of the conveying path along the switching guide 25. FIGS. 16, 17 and 18 are schematic views for illustrating a configuration and operation of the switching mechanism for switching the face-up tray switching guide 45 and the switching guide 25 in conjunction with the opening-and-closing of the tray portion 72. FIG. 16 shows a state where the tray portion 72 is closed and the switching guide 25 is in the ejection position Pa1. FIG. 17 shows a state where the tray portion 72 is closed and the switching guide 25 is in the inverting position Pa2. FIG. 18 shows a state where the tray portion 72 is opened and the face-up tray 36 is in the opening position (i.e., where the face-up tray 36 is in the use state). In this regard, FIGS. 16, 17 and 18 show the switching mechanism as seen from the −Y side.

In FIGS. 16, 17 and 18, the electromagnetic solenoid 48, the first link lever 47 and the switching guide 25 are linked with each other and are biased by the torsion spring 50 as described with reference to FIG. 5.

The face-up tray switching guide 45 has a rotation shaft 45*a* rotatably supported by the guide chassis 60 (FIG. 15). A torsion spring 85 is provided around the rotation shaft 45*a*, and both ends of the torsion spring 85 are pressed against the face-up tray switching guide 45 and the guide chassis 60. The face-up tray switching guide 45 is biased by the torsion spring 85 in a direction in which the face-up tray switching guide 45 rotates from the retracted position Pc1 (i.e., the third position) toward the ejection position Pc2 (i.e., the fourth position), i.e., in a direction shown by an arrow J. The face-up tray switching guide 45 further includes a protrusion 45*b* which is contactable with a regulating surface 72*a* of the tray portion 72, and a guide portion 45*c* which is contactable with an engaging portion 81*b* of the second link lever 81. The guide portion 45*c* guides the recording sheet 1 which is being conveyed.

The second link lever 81 has a rotation shaft 81*a* rotatably supported by the guide chassis 60 (FIG. 15). A torsion spring 82 is provided around the rotation shaft 81*a*, and both ends of the torsion spring 82 are pressed against the second link lever 81 and the guide chassis 60. The second link lever 81 is biased by the torsion spring 82 in a direction in which the second link lever 81 contacts the face-up tray switching guide 45, i.e., in a direction shown by an arrow G. The second link lever 81 further includes an engaging portion 81*b* that engages the guide portion 45*c* of the face-up tray switching guide 45 and a pressing portion 81*c* which is contactable with an engaging portion 47*d* of the first link lever 47.

In addition, the face-up tray switching guide 45, the second link lever 81, the first link lever 47, and the torsion springs 85, 82 and 80 correspond to a moving mechanism.

As shown in FIG. 16, when the tray portion 72 is closed, the protrusion 45*b* of the face-up tray switching guide 45 contacts the regulating surface 72*a* formed on an inner wall surface of the tray portion 72, and therefore the face-up tray switching guide 45 is held in the retracted position Pc1 and is prevented from rotating further in the direction shown by the arrow J. Further, the engaging portion 81*b* of the second link lever 81 contacts the guide portion 45*c* of the face-up tray switching guide 45, and therefore the second link lever 81 is prevented from rotating further in the direction shown by the arrow G. The pressing portion 81*c* of the second link lever 81 and the engaging portion 47*d* of the first link lever 47 are constantly apart from each other irrespective of the rotation of the first link lever 47.

Therefore, in a state where the tray portion 72 is closed, the switching mechanism for the switching guide 25 (i.e., the electromagnetic solenoid 48 and the first link lever 47) performs switching between positions of the switching guide 25 in the duplex printing or the like, without being affected by movement of the second link lever 81. The face-up tray switching guide 45 which is in the retracted position Pc1 does not enter into the conveying path in the printing of the normal recording sheet 1 as shown in, for example, FIG. 3.

FIG. 16 shows a state where the tray portion 72 is closed, and the switching guide 25 is switched to the ejection position Pa1 by turning OFF the electromagnetic solenoid 48. In this state, the recording sheet 1 conveyed from the ejection roller 23 (provided along the first conveying path 64) is further conveyed along the first conveying path 64, and is ejected to the stacker 30 as shown in FIG. 9.

Figure 7:
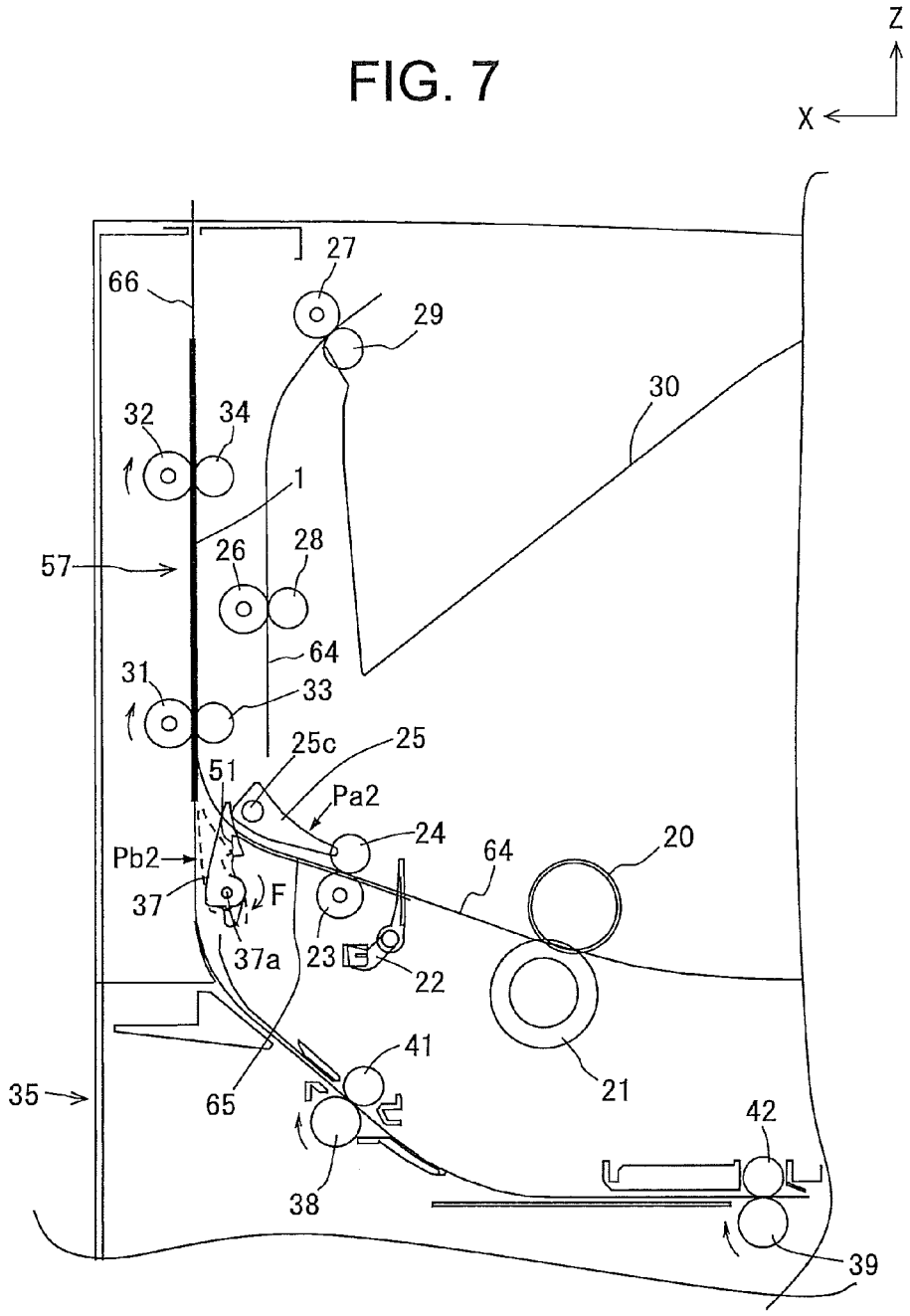
FIG. 7 is a schematic view for illustrating the conveyance of the recording sheet in the duplex printing according to Embodiment 1.

FIG. 17 shows a state where the tray portion 72 is closed, and where the switching guide 25 is switched to the inverting position Pa2 by turning ON the electromagnetic solenoid 48. In this state, the recording sheet 1 conveyed from the ejection roller 23 provided along the first conveying path 64 is guided to the second conveying path 65 (branched from the first conveying path 64) by the switching guide 25, is guided to the third conveying path 66 (branched from the second conveying path 65) by the face-up tray switching guide 45, and is conveyed to the draw-in position 57 as shown in FIG. 7.

The tray opening-and-closing detector 61 (i.e., a detection unit) is constituted by an optical sensor. When the tray portion 72 is closed, a light shielding portion 81*d* (FIG. 16) of the second link lever 81 interferes a light path of the tray opening-and-closing detector 61. The tray opening-and-closing detector 61 outputs detection signal (base on whether the light path is interrupted or not) to the control unit 55. With the detection signal from the tray opening-and-closing detector 61, the control unit 55 determines whether the tray portion 72 is opened or closed.

Next, operations of respective components when the user releases the locking of the tray portion 72 and opens the tray portion 72 from the state shown in FIG. 16 will be described.

If the tray portion 72 starts rotating toward the opening position shown in FIG. 18, the regulating surface 72*a* of the tray portion 72 moves apart from the protrusion 45*b*, and therefore the face-up tray switching guide 45 is allowed to rotate in the direction shown by the arrow J. Therefore, the face-up tray switching guide 45 starts rotating in the direction shown by the arrow J by the biasing force of the torsion spring 85. The guide portion 45*c* of the face-up tray switching guide 45 contacts and presses the engaging portion 81*b* of the second link lever 81 biased by the torsion spring 82, and the second link lever 81 rotates in the direction shown by an arrow H. In this regard, strengths of the respective torsion springs 50, 82 and 85 are so set that, at a contact portion between the engaging portion 81*b* and the guide portion 45*c*, the biasing force of the torsion spring 85 is exceeds the biasing forces of the other torsion springs 50 and 82.

As the second link lever 81 starts rotation in the direction shown by the arrow H, the control unit 55 determines that the tray portion 72 is opened by the signal outputted from the tray opening-and-closing detector 61, and turns OFF the electromagnetic solenoid 48 unconditionally. Therefore, irrespective of whether the electromagnetic solenoid 48 has been ON or OFF, the electromagnetic solenoid 48 is turned OFF when the tray portion 72 is opened. Therefore, if the electromagnetic solenoid 48 has been ON as shown in FIG. 17, the electromagnetic solenoid 48 shifts to a state shown in FIG. 16 when the tray portion 72 is opened. If the electromagnetic solenoid 48 has been OFF, the electromagnetic solenoid 48 keeps the state shown in FIG. 16.

In either case, the pressing portion 81*c* of the second link lever 81 rotating in the direction shown by the arrow H by the biasing force of the torsion spring 85 contacts and presses the engaging portion 47*d* of the first link lever 47 so as to rotate the first link lever 47 in the direction shown by the arrow D. Therefore, the switching guide 25 is kept in the inverting position Pa2 as shown in FIG. 18. Moreover, by the rotation of the face-up tray switching guide 45 at this time, the face-up tray switching guide 45 is switched from the retracted position Pc1 to the ejection position Pc2.

As shown in FIGS. 10 and 18, in a state where the multipurpose feeder 101 and the face-up tray 36 of the printer 1000 are both opened (i.e., where the multipurpose feeder 101 and the face-up tray 36 are both in use state), the thick recording sheet conveyed from the multipurpose feeder 101 is subjected to printing by the image forming unit 14, is conveyed by the ejection roller 23 provided on the first conveying path 64, and is guided to the second conveying path 65 branched from the first conveying path 64 by the switching guide 25 in the inverting position Pa2. Further, the thick recording sheet is guided by the face-up tray switching guide 45 (which is in the ejection position Pc2) and conveyed along the second conveying path 65 to reach the conveying roller 31 and the pinch roller 46. Then, the thick recording sheet is ejected to the tray portion 72 and the sub-trays 73 and 74 forming the continuous flat surface.

In this regard, the torsion spring 85 generates a biasing force so as to switch the switching guide 25 from the ejection position Pa1 to the inverting position Pa2 resisting the biasing forces of the torsion spring 50 and the torsion spring 82 and resisting weights of the plunger 49 and the first link lever 47.

In the printer 1000 of this embodiment, when the face-up tray 36 is set in the use state (i.e., when the tray portion 76 is opened), the switching guide 25 is switched to the inverting position Pa2 in conjunction with the operation (i.e., an opening) of the face-up tray 36 via a link mechanism without using an electromagnetic solenoid 48.

Since the switching guide 25 is set to the inverting position Pa2 without using the electromagnetic solenoid 48, it is not necessary to keep the electromagnetic solenoid 48 ON for a long time. Therefore, electric consumption can be reduced, and excessive heat generation can be prevented.

In the above described embodiment, a monochromatic electrophotographic printer has been described as an example of the image forming apparatus. However, the present invention is not limited to such a monochromatic electrophotographic printer, but is also applicable to a color electrophotographic printer. Further, the present invention is applicable to, for example, an MFP (Multi-Function Peripheral), a copier or the like having a duplex printing function, a multipurpose feeder and a face-up tray.

While the preferred embodiments of the present invention have been illustrated in detail, it should be apparent that modifications and improvements may be made to the invention without departing from the spirit and scope of the invention as described in the following claims.

What is claimed is:

1. A medium conveying device, comprising:

a first stacker to which a medium is ejected;

a first conveying path guiding the medium to the first stacker;

a second conveying path branched from the first conveying path at a first branching position, the second conveying path guiding the medium;

a third conveying path branched from the second conveying path at a second branching position, the third conveying path guiding the medium;

a second stacker to which the medium guided by the second conveying path is ejected, the second stacker being provided on an apparatus main body so as to be openable and closable;

a first switching unit movable between a first position and a second position, the first switching unit guiding the medium to the first conveying path at the first branching position when the first switching unit is in the first position, and guiding the medium to the second conveying path at the first branching position when the first switching unit is in the second position; and a moving mechanism that moves the first switching unit from the first position to the second position in conjunction with an opening operation of the second stacker, wherein the moving mechanism comprises a second switching unit movable between a third position and a fourth position, wherein the second switching unit guides the medium to the third conveying path at the second branching position when the second switching unit is in the third position, and guides the medium to the second conveying path at the second branching position when the second switching unit is in the fourth position, and wherein the moving mechanism moves the second switching unit from the third position to the fourth position in conjunction with the opening operation of the second stacker.

2. The medium conveying device according to claim 1, comprising:

a driving unit that switches a position of the first switching unit using electricity;

a control unit that controls the driving unit; and a detection unit that detects that the second stacker is in a closing position, wherein, when the second stacker is in the closing position, the control unit causes the driving unit to switch the position of the first switching unit.

3. The medium conveying device according to claim 2, wherein, in a state where the second stacker is in the closing position and where the driving unit is OFF, the first switching unit keeps the first position so that the medium is guided to the first stacker via the first conveying path.

4. The medium conveying device according to claim 2, wherein, when the driving unit is turned ON in a state where the second stacker is in the closing position, the first switching unit moves to the second position so that the medium is guided to the third conveying path, and wherein a conveying direction of the medium is inverted by turning OFF the driving unit to cause the first switching unit to move to the first position.

5. The medium conveying device according to claim 2, wherein, in accordance with the opening operation of the second stacker, the moving mechanism moves the first switching unit to the first position and moves the second switching unit to the fourth position, and the control unit turns OFF the driving unit.

6. The medium conveying device according to claim 2, wherein the first switching unit is switched by the driving unit or is switched in conjunction with the operation of the second stacker.

7. The medium conveying device according to claim 1, wherein the moving mechanism moves the second switching unit from the fourth position to the third position in conjunction with a closing operation of the second stacker.

8. The medium conveying device according to claim 1, wherein the moving mechanism moves the first switching unit from the second position to the first position in conjunction with a closing operation of the second stacker.

9. The medium conveying device according to claim 1, wherein the second switching unit is rotatably supported and is biased in a direction from the third position toward the fourth position, wherein the moving mechanism comprises:

a second link lever rotatably supported and biased in a direction in which the second link lever contacts the second switching unit; and a first link lever that contacts the first switching unit to switch the first switching unit between the first position and the second position, the first link lever being rotatably supported at a position where the first link lever is contactable with the second link lever, wherein, when the second stacker is in a closing position, the second switching unit is in the third position and is prevented from moving toward the fourth position, and the first link lever and the second link lever are apart from each other;

wherein the second switching unit moves from the third position to the fourth position in conjunction with the opening operation of the second stacker;

wherein, in conjunction with a movement of the second switching unit from the third position to the fourth position, the second link lever rotates and pushes the first link lever; and wherein the first link lever pushed by the second link lever rotates so as to switch the first switching unit from the first position to the second position.

10. The medium conveying device according to claim 9, wherein the first switching unit is rotatably supported and is applied with a biasing force in a direction from the second position to the first position, and wherein the first link lever restricts the first switching unit from being rotated by the biasing force.

11. An image forming apparatus comprising the medium conveying device according to claim 1.

12. The image forming apparatus according to claim 11, wherein the first conveying path guides the medium to the first stacker in such an orientation that a surface of the medium on which an image is formed faces the first stacker, wherein the second conveying path guides the medium to the second stacker in such an orientation that a surface of the medium on which the image is formed faces away from the second stacker, and wherein the third conveying path guides the medium in a first direction and guides the medium in a second direction opposite to the first direction.

13. The medium conveying device according to claim 1, wherein the first conveying path and the third conveying path extend to positions higher than the second conveying path.

14. The medium conveying device according to claim 1, wherein the third conveying path extends across the second conveying path between a position higher than the second conveying path and a position lower than the second conveying path.

* * * * *